US012773028B1

(12) United States Patent
Alberts et al.

(10) Patent No.: US 12,773,028 B1
(45) Date of Patent: Oct. 27, 2026

(54) DRAWSTRING ACCESS SYSTEM

(71) Applicants: Tim Alberts, Lemont, IL (US); Beth Alberts, Lemont, IL (US)

(72) Inventors: Tim Alberts, Lemont, IL (US); Beth Alberts, Lemont, IL (US)

( * ) Notice: Subject to any disclaimer, the term of this patent is extended or adjusted under 35 U.S.C. 154(b) by 0 days.

(21) Appl. No.: 19/221,666

(22) Filed: May 29, 2025

(51) Int. Cl.

| | |
|---|---|
| ***A41D 1/04*** | (2006.01) |
| ***A41F 1/00*** | (2006.01) |
| ***A42B 1/04*** | (2021.01) |
| ***A44B 19/00*** | (2006.01) |

(52) U.S. Cl.
CPC ..... *A42B 1/04* (2013.01); *A41D 1/04* (2013.01); *A41F 1/002* (2013.01); *A44B 19/00* (2013.01); *A41D 2200/20* (2013.01)

(58) Field of Classification Search
CPC ..... A41F 9/00; A41F 9/002; A41D 2200/20; A42B 1/24; A42B 1/241
See application file for complete search history.

(56) References Cited

U.S. PATENT DOCUMENTS

| | | | | |
|---|---|---|---|---|
| 2,994,091 | A | 8/1961 | Aftergood, Jr. | |
| 4,466,137 | A | 8/1984 | Carnaghi | |
| 5,191,659 | A * | 3/1993 | Backus | A41D 13/1254 2/76 |
| 5,524,800 | A | 6/1996 | Arney | |
| 8,522,365 | B2 | 9/2013 | Geary | |
| 9,149,081 | B2 | 10/2015 | Wilson, II | |
| 10,537,144 | B1 * | 1/2020 | Suttman | A42B 3/048 |
| D1,062,153 | S | 2/2025 | Lee | |
| 2007/0050890 | A1 | 3/2007 | Purnell | |
| 2007/0261150 | A1 * | 11/2007 | Oomae | A41F 9/02 2/221 |
| 2015/0007380 | A1 | 1/2015 | Hodgdon | |

FOREIGN PATENT DOCUMENTS

| | | |
|---|---|---|
| WO | WO2015010063 | 1/2015 |

* cited by examiner

*Primary Examiner* — Katherine M Moran

(57) ABSTRACT

A drawstring access system for directly and conveniently accessing the drawstring includes a garment with a channel that extends through the garment. A drawstring is positioned within the channel. A fastener is coupled to the garment. The fastener is aligned with the channel wherein the fastener is selectively releasable to expose the channel and wherein the fastener is selectively engageable to cover the channel. The drawstring is accessible within the channel when the channel is exposed wherein the fastener is designed to facilitate a user in positioning the drawstring within the channel.

16 Claims, 10 Drawing Sheets

DRAWSTRING ACCESS SYSTEM

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to articles of clothing with drawstrings and more particularly pertains to a new article of clothing with drawstrings for directly and conveniently accessing the drawstring.

(2) Description of Related Art Including Information Disclosed Under 37 CFR 1.97 and 1.98

The prior art relates to articles of clothing with drawstrings. Drawstrings are a common fastening mechanism in garments, particularly in activewear and casual clothing. However, they are prone to retracting into the garment casing during washing, wear, or adjustment, creating a frustrating user experience and often requiring time-consuming retrieval or replacement. This recurring issue has prompted the development of several inventions aimed at preventing drawstring retraction and simplifying drawstring management.

One approach involves mechanical clamping devices that affix to the ends of the drawstring, preventing them from slipping into the fabric channel. These clamps may also serve a decorative function or display branding. Another common solution integrates cord locks with extension sleeves that protrude from the garment, holding the drawstring in place and maintaining its accessibility. These mechanisms are generally designed to secure and effectively control the movement of drawstrings. Other solutions focus on the design of the garment itself. For instance, certain clothing items, such as martial arts uniforms, incorporate multiple channel stitches within the waistband to segment the drawstring and reduce tangling and retraction.

These devices reflect ongoing efforts to enhance garment usability by addressing the persistent and well-known issue of drawstring retraction. Nevertheless, there remains a need for a more integrated, intuitive, and durable solution that prevents drawstrings from becoming lost within garments without compromising comfort or aesthetic design. Specifically, there remains a need for a way to provide direct, easy access to the drawstring itself when it retracts into the garment.

(h) BRIEF SUMMARY OF THE INVENTION

An embodiment of the disclosure meets the needs presented above by generally comprising a garment with a channel that extends through the garment. A drawstring is positioned within the channel. A fastener is coupled to the garment. The fastener is aligned with the channel wherein the fastener is selectively releasable to expose the channel and wherein the fastener is selectively engageable to cover the channel. The drawstring is accessible within the channel when the channel is exposed wherein the fastener is designed to facilitate a user in positioning the drawstring within the channel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
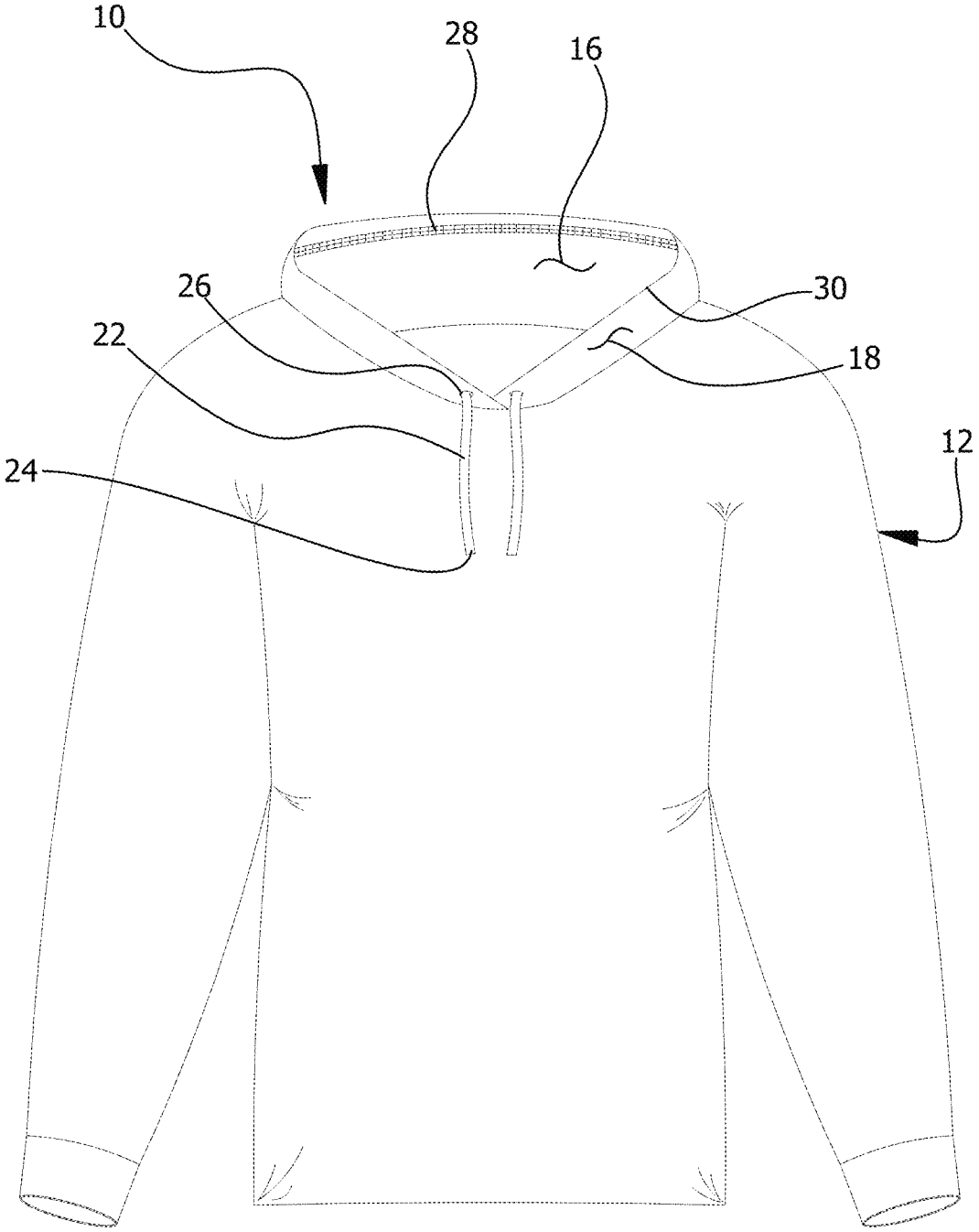
FIG. 1 is a front view of a drawstring access system according to an embodiment of the disclosure.
Figure 2:
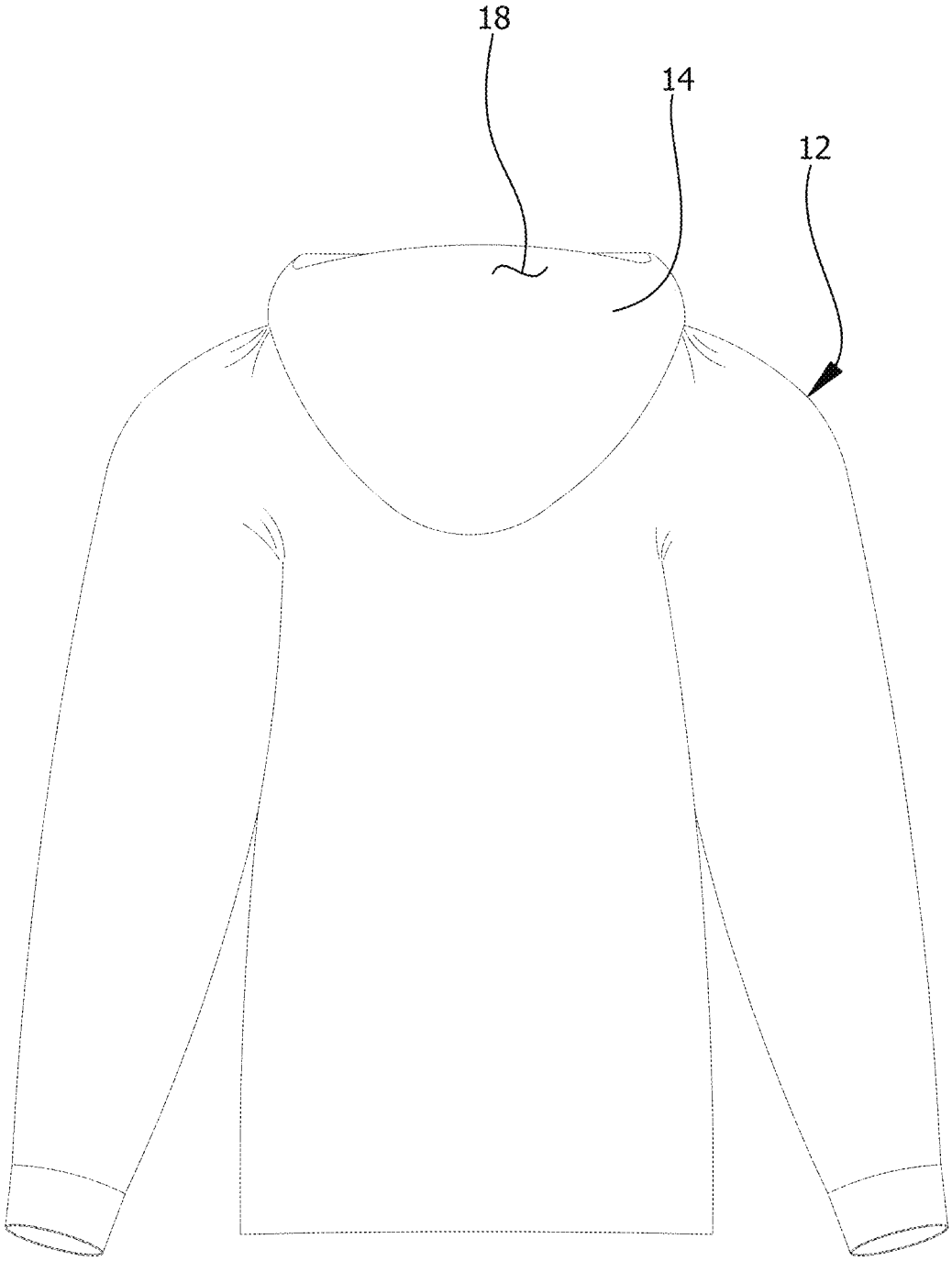
FIG. 2 is a rear view of an embodiment of the disclosure.
Figure 3:
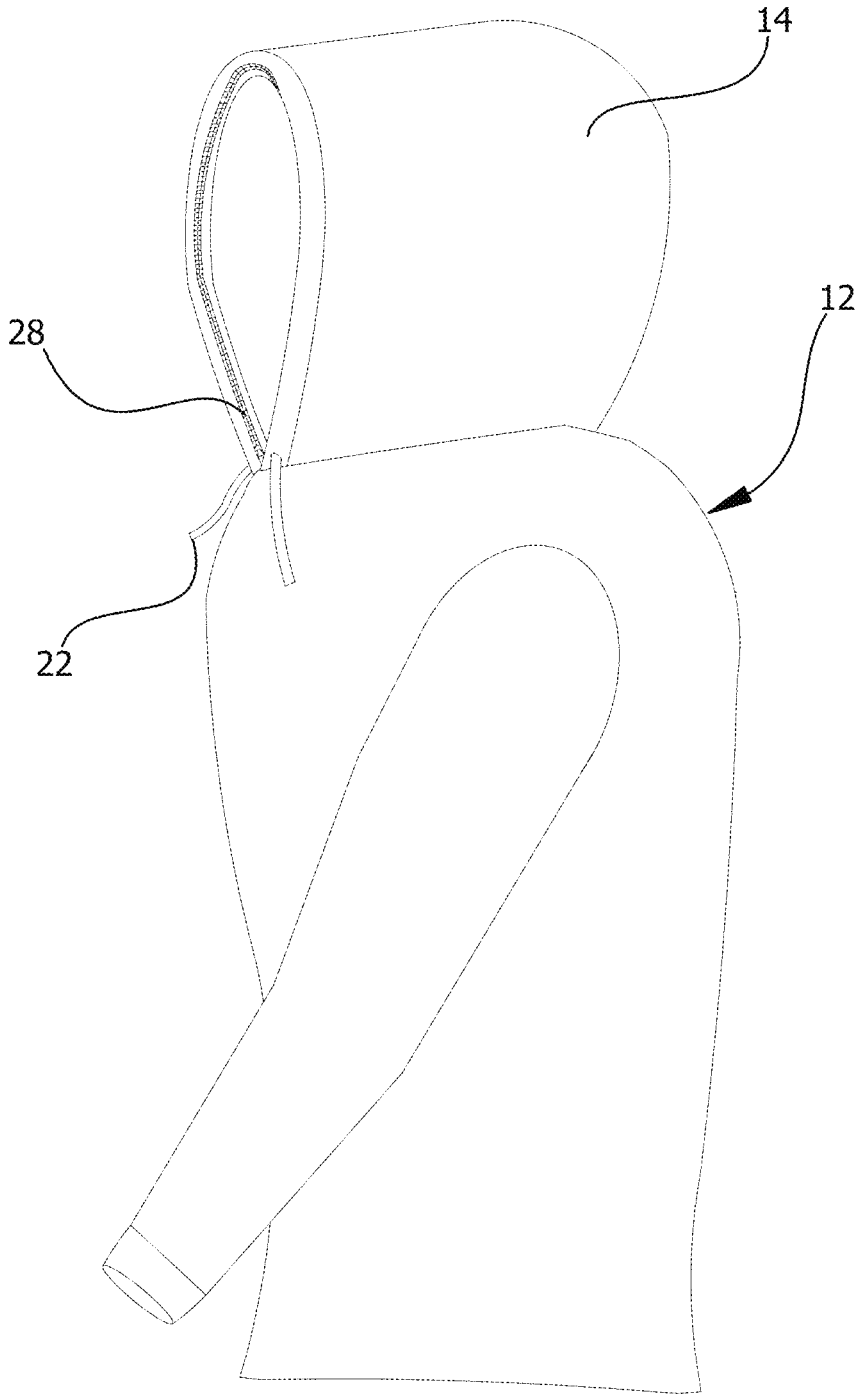
FIG. 3 is a side view of an embodiment of the disclosure.
Figure 4:
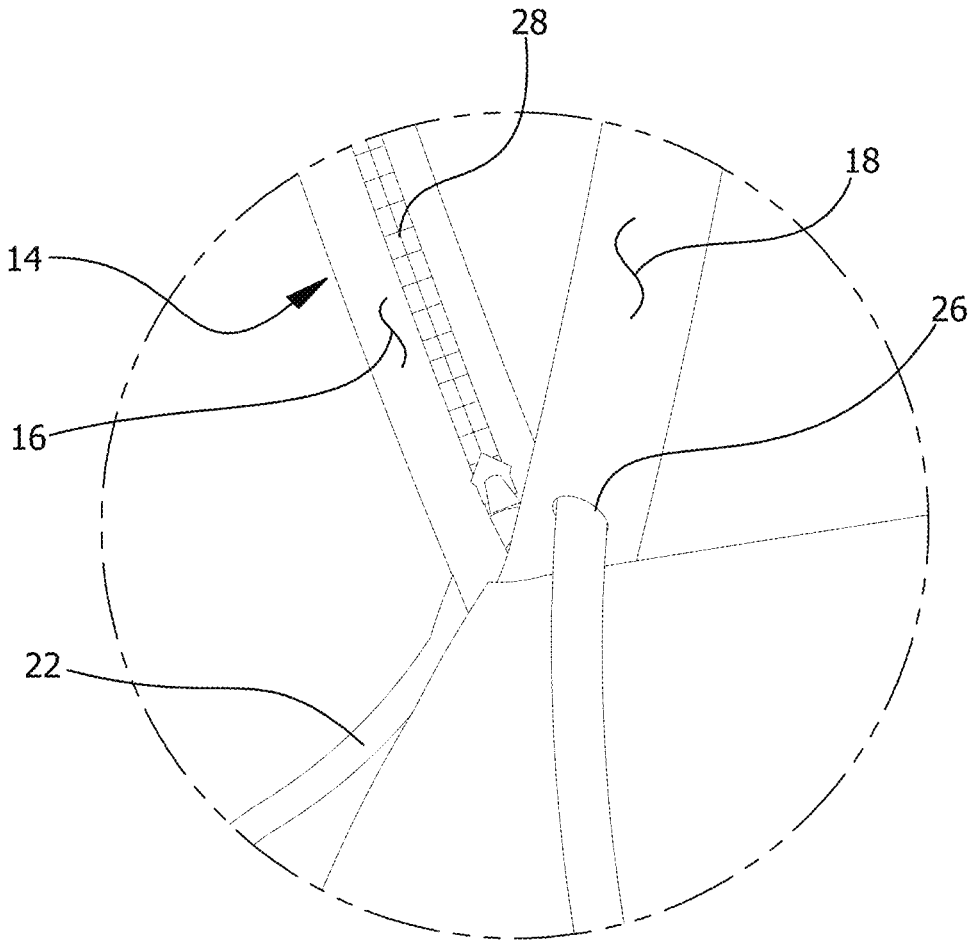
FIG. 4 is a detail view of an embodiment of the disclosure.
Figure 5:
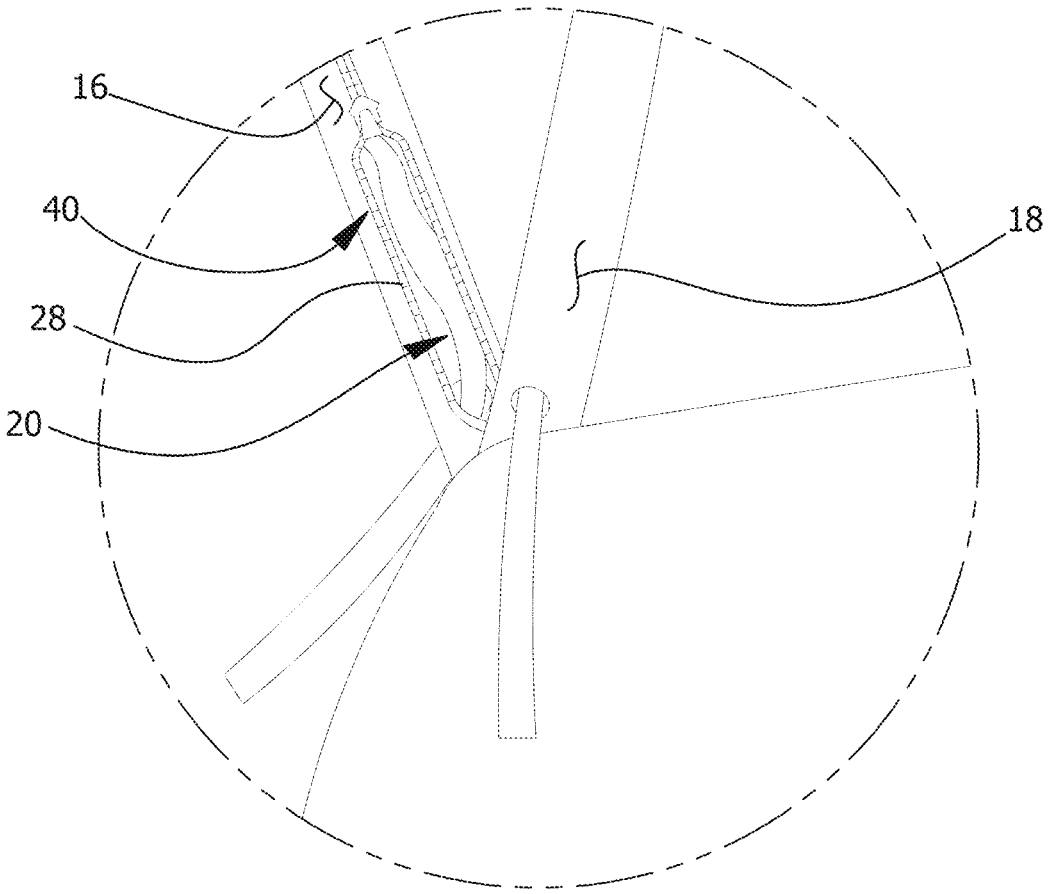
FIG. 5 is a detail view of an embodiment of the disclosure.
Figure 6:
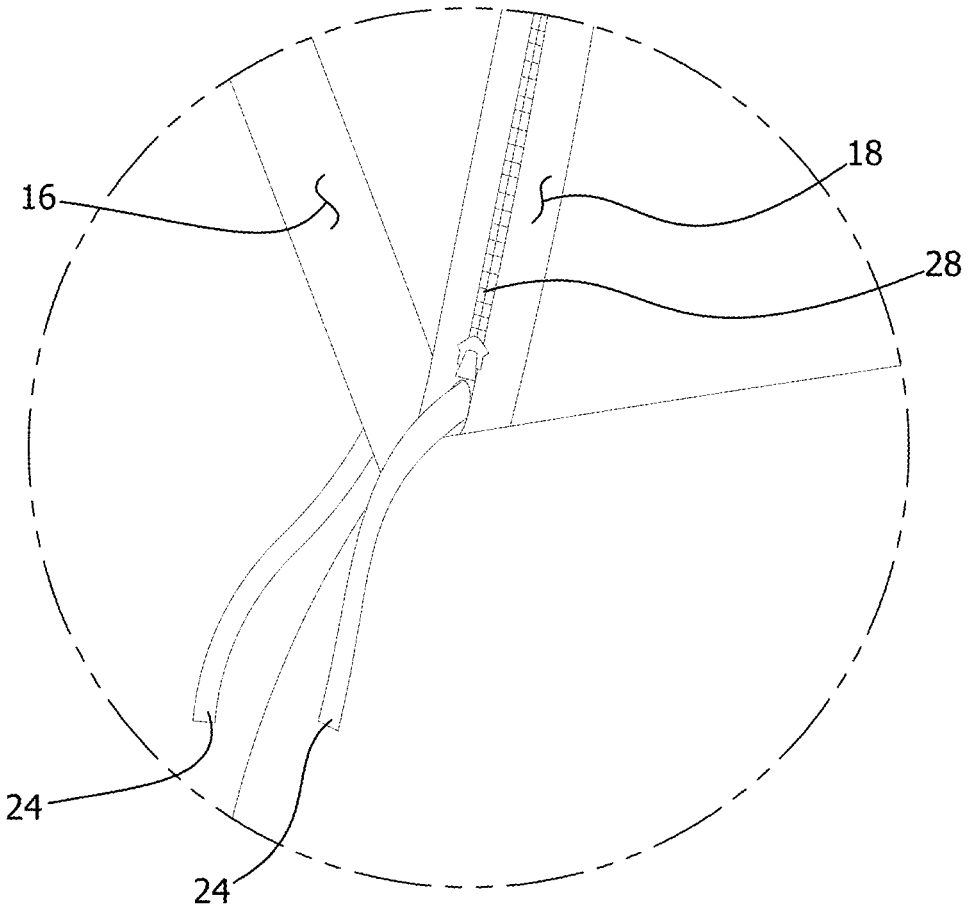
FIG. 6 is a detail view of an embodiment of the disclosure.
Figure 7:
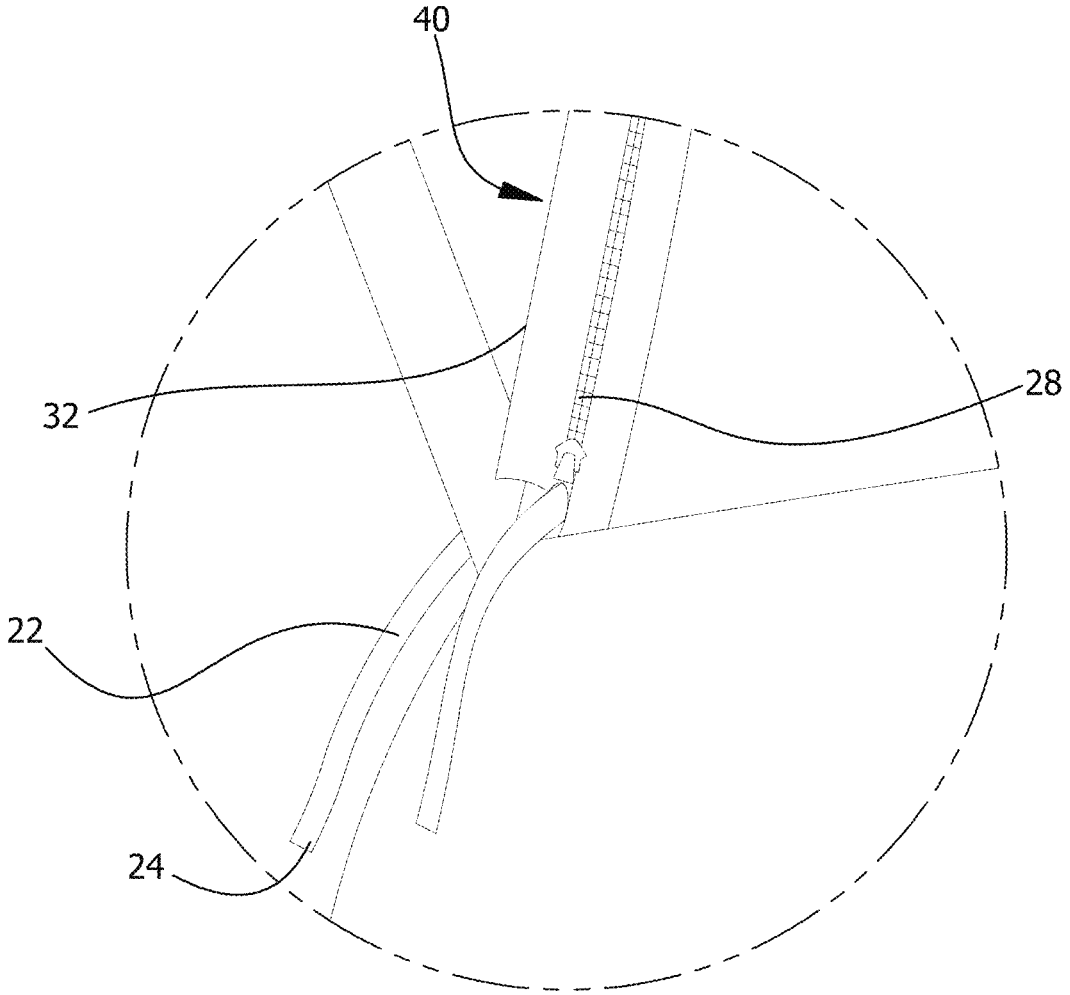
FIG. 7 is a detail view of an embodiment of the disclosure.

With reference now to the drawings, and in particular to FIGS. 1 through 10 thereof, a new article of clothing with drawstrings embodying the principles and concepts of an embodiment of the disclosure and generally designated by the reference numeral 10 will be described.

As best illustrated in FIGS. 1 through 10, the drawstring access system 10 generally comprises a garment 12. The garment 12 may have a hood 14 with an inner surface 16 and an outer surface 18. Alternatively, the garment 12 may have a waistband 38 with the inner surface 16 and the outer surface 18. A channel 20 extends through the hood 14, or the waistband 38, of the garment 12. The channel 20 is positioned between the inner surface 16 and the outer surface 18. A drawstring 22 is positioned within the channel 20. The drawstring 22 has a pair of opposing ends 24 and is elongated between the pair of opposing ends 24.

Figure 10:
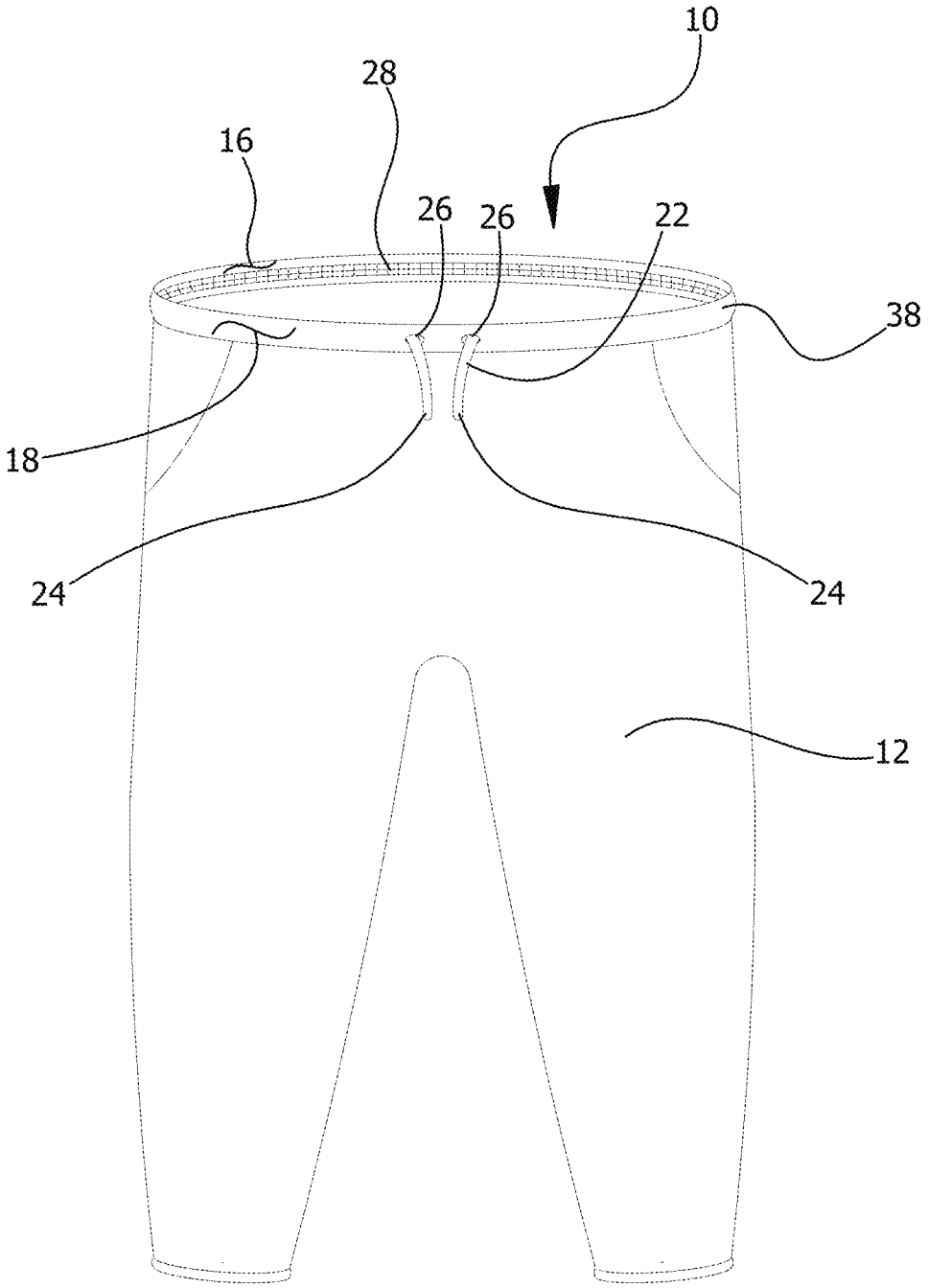
FIG. 10 is a front view of an embodiment of the disclosure.

A pair of apertures 26 may extend through the outer surface 18 of the hood 14 into the channel 20. The drawstring 22 extends outwardly from the channel 20 through the pair of apertures 26 wherein each opposing end of the pair of opposing ends 24 is positioned outside of the channel 20 proximate to a respective aperture of the pair of apertures 26. As shown in FIG. 10, the pair of apertures 26 may alternatively extend through the outer surface 18 of the waistband 38 into the channel 20. Embodiments wherein the pair of apertures 26 extend through the inner surface 16 of either the hood 14 or the waistband 38 of the garment 12 are also contemplated, as long as the pair of apertures 26 extend into the channel 20 for extending the drawstring 22 through each aperture of the pair of apertures 26 to position the pair of opposing ends 24 outside of the channel 20. The drawstring 22 typically has a diameter that is less than a diameter of the pair of apertures 26 wherein the drawstring 22 is retractable into the channel 20 through each aperture of the pair of apertures 26 and wherein the drawstring 22 is extendable outwardly from the channel 20 through each aperture of the pair of apertures 26.

A fastener 28 is coupled to the hood 14. The fastener 28 is aligned with the channel 20 because the fastener 28 is selectively releasable to expose the channel 20. The fastener 28 is also selectively engageable to cover the channel 20. The drawstring 22 is accessible within the channel 20 when the channel 20 is exposed wherein the fastener 28 is configured to facilitate a user in positioning the drawstring 22 within the channel 20 and in removing the drawstring 22 from the channel 20.

For example, when an opposing end of the pair of opposing ends 24 of the drawstring 22 retracts into the channel 20 through the respective aperture of the pair of apertures 26, the fastener 28 may be released to expose the channel 20 to facilitate access to the drawstring 22. With access to the drawstring 22 within the channel 20, the opposing end of the pair of opposing ends 24 can be extended outwardly from the channel 20 through the respective aperture of the pair of apertures 26. The fastener 28 may have a length that is equal to a length of the channel 20 wherein the channel 20 is fully exposed when the fastener 28 is fully released. An entirety of the drawstring 22 positioned within the channel 20 is accessible when the channel 20 is fully exposed.

Because the drawstring 22 extends through the pair of apertures 26 to be visible when a user is wearing the garment 12, the drawstring 22 typically has a diameter that is less than a diameter of the pair of apertures 26. This size differential can result in regular retraction of the drawstring 22 into the channel 20, for example when a user pulls on the drawstring 22 or when the garment 12 is washed and dried. When only the pair of apertures 26 provide access to the channel 20, it can be extremely difficult and frustrating to attempt to retrieve the drawstring 22 so that it can be re-inserted through the respective aperture of the pair of apertures 26 for access and use by the user. The fastener 28 provides access to the channel 20 to eliminate such difficulties and frustrations because the user can merely disengage the fastener 28 and reach into the channel 20 for direct access to the drawstring 22.

When the fastener 28 is fully engaged, the channel 20 may be fully covered to secure the drawstring 22 within the channel 20. The fastener 28 is preferably positioned on the inner surface 16 of the garment 12, proximate to a perimeter edge 30 of the hood 14. The perimeter edge 30 defines a junction between the outer surface 18 and the inner surface 16. However, alternative positions for the fastener 28 are also contemplated, as long as the fastener 28 is aligned with and provides access to the channel 20. For example, the fastener 28 may be positioned on the outer surface 18 of the garment 12.

A flap 32 may be pivotably coupled to the hood 14 of the garment 12 wherein the flap 32 is selectively positionable in an open configuration 40 and a closed configuration 42. The flap 32 preferably exposes an entirety of the fastener 28 when the flap 32 is in the open configuration 40 and covers an entirety of the fastener 28 when the flap 32 is in the closed configuration 42.

The fastener 28 may further include a primary member 34, which may be coupled to the hood 14 or the waistband 38 of the garment 12. A secondary member 36 is releasably engageable with the primary member 34. For example, the secondary member 36 may be coupled to an interior surface of the flap 32. The secondary member 36 is aligned with the primary member 34.

The primary member 34 and the secondary member 36 of the fastener 28 may each comprise a magnetic material wherein the secondary member 36 is magnetically attracted to the primary member 34 such that the magnetic attraction between the primary member 34 and the secondary member 36 securely engages the fastener 28 to close the channel 20. The primary member 34 and the secondary member 36 of the fastener 28 may, alternatively, each comprise a hook and loop material, an insertion portion and a receiving portion of a snap, a button and a buttonhole, or other appropriate fastening means.

Figure 8:
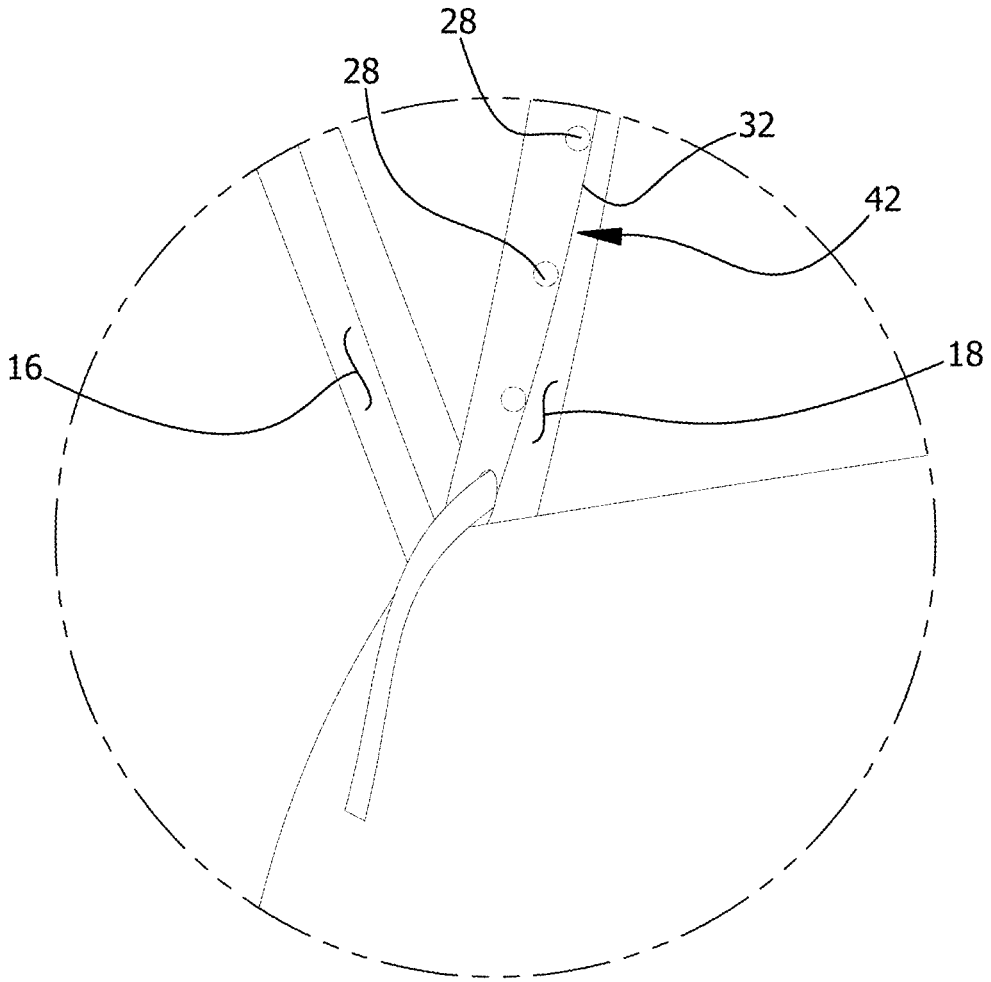
FIG. 8 is a detail view of an embodiment of the disclosure.
Figure 9:
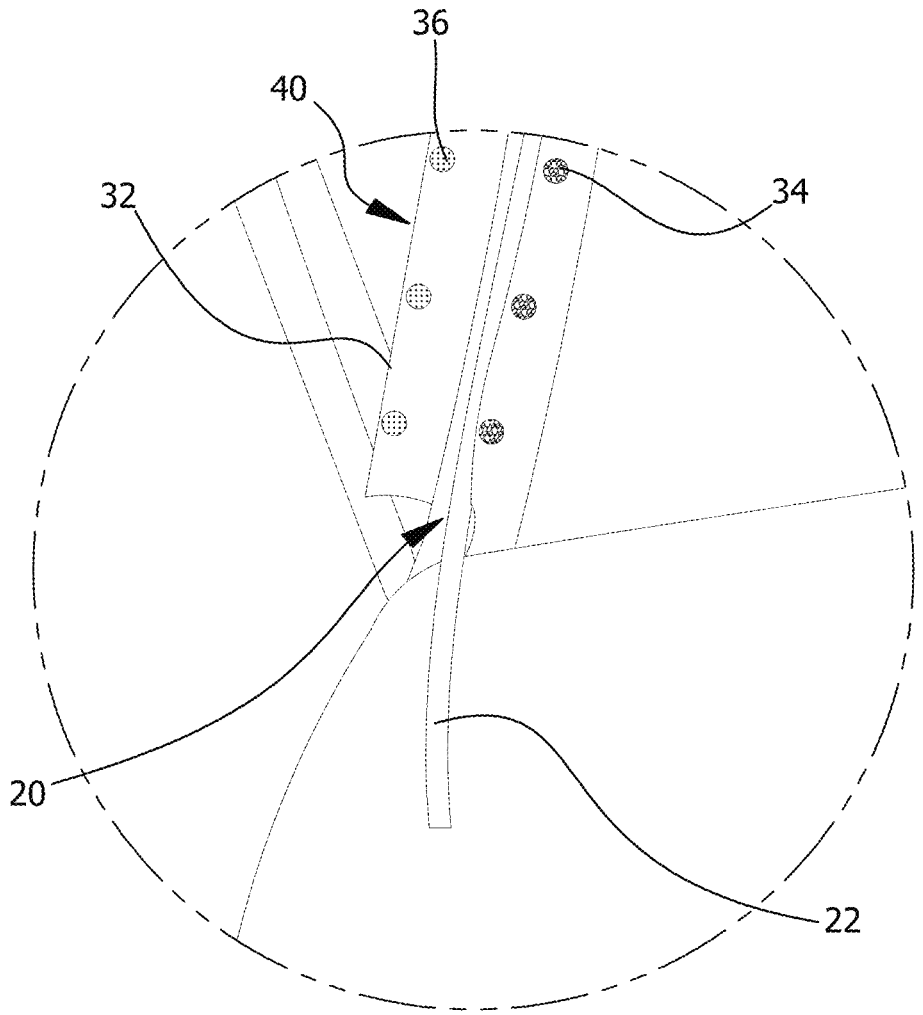
FIG. 9 is a detail view of an embodiment of the disclosure.

As shown in FIGS. 8 and 9, the fastener 28 may be one of a plurality of fasteners that are spaced from each other along the length of the channel 20. More specifically, the primary member 34 may be one of a plurality of primary members and the secondary member 36 may be one of a plurality of secondary members wherein each secondary member 36 of the plurality of secondary members is aligned with a respective primary member 34 of the plurality of primary members across a width of the channel 20. However, the fastener 28 is preferably a zipper because a zipper is quick and easy to engage and disengage.

In use, the garment 12 can be worn as normal. When the drawstring 22 retracts into the channel 20, or becomes stuck within the channel 20, the fastener 28 can be released to expose the channel 20 and retrieve the drawstring 22. The pair of opposing ends 24 of the drawstring 22 can be inserted through the pair of apertures 26, which may extend through the inner surface 16 or the outer surface 18 of the garment 12. The drawstring 22 may also be removed from the channel 20 and replaced, for example to facilitate the user in customizing the garment 12 for various occasions.

The fastener 28 is preferably positioned on the inner surface 16 of the garment 12, or more specifically, on the inner surface 16 of the hood 14 or the waistband 38. When the fastener 28 is positioned on the inner surface 16, the fastener 28 is generally inhibited from being visible to a person who is looking at the user. Such embodiments are preferred to facilitate the garment 12 in looking like a traditional garment 12, such as a traditional hooded sweatshirt or a traditional pair of sweatpants. However, the fastener 28 may also be positioned on the outer surface 18 of the garment 12. In some such instances, the flap 32 may cover the fastener 28 to facilitate the garment 12 in looking more traditional.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An apparel assembly comprising:

a garment having a hood with an inner surface and an outer surface;

a channel extending through the garment;

a drawstring being positioned within the channel; and a fastener being coupled to the garment, the fastener being aligned with the channel wherein the fastener is selectively releasable to expose the channel and wherein the fastener is selectively engageable to cover the channel, the drawstring being accessible within the channel when the channel is exposed wherein the fastener is configured to facilitate a user in removing the drawstring from the channel.

2. The apparel assembly of claim 1, wherein the channel is positioned between the inner surface and the outer surface of the hood of the garment.

3. The apparel assembly of claim 2, wherein the fastener is positioned proximate to a perimeter edge of the hood, the perimeter edge defining a junction between the outer surface and the inner surface.

4. The apparel assembly of claim 3, wherein the fastener is positioned on the inner surface of the hood.

5. The apparel assembly of claim 3, wherein the fastener is positioned on the outer surface of the hood.

6. The apparel assembly of claim 5, further comprising a flap being pivotably coupled to the hood of the garment wherein the flap is selectively positionable in an open configuration and a closed configuration, the flap covering the fastener when the flap is in the closed configuration.

7. The apparel assembly of claim 6, wherein the flap covers an entirety of the fastener when the flap is in the closed configuration and wherein the flap exposes an entirety of the fastener when the flap is in the open configuration.

8. The apparel assembly of claim 6, the fastener further comprising:

a primary member being coupled to the outer surface of the hood; and a secondary member being releasably engageable with the primary member, the secondary member being coupled to an interior surface of the flap.

9. The apparel assembly of claim 8, the fastener further comprising a magnetic material.

10. The apparel assembly of claim 8, the fastener further comprising a hook and loop material.

11. The apparel assembly of claim 2, further comprising a pair of apertures extending through the hood into the channel, the drawstring extending outwardly from the channel through the pair of apertures wherein each opposing end of the pair of opposing ends is positioned outside of the channel proximate to a respective aperture of the pair of apertures.

12. The apparel assembly of claim 11, wherein the drawstring has a diameter being less than a diameter of the pair of apertures wherein the drawstring is retractable into the channel through each aperture of the pair of apertures and wherein the drawstring is extendable outwardly from the channel through each aperture of the pair of apertures.

13. The apparel assembly of claim 1, wherein the fastener has a length being equal to a length of the channel wherein the channel is fully exposed when the fastener is fully released, an entirety of the drawstring within the channel being accessible when the channel is fully exposed.

14. The apparel assembly of claim 1, wherein the fastener is a zipper.

15. An apparel assembly comprising:

a garment having a hood with an inner surface and an outer surface;

a channel extending through the hood of the garment, the channel being positioned between the inner surface and the outer surface;

a drawstring being positioned within the channel, the drawstring having a pair of opposing ends;

a pair of apertures extending through the outer surface of the hood into the channel, the drawstring extending outwardly from the channel through the pair of apertures wherein each opposing end of the pair of opposing ends is positioned outside of the channel proximate to a respective aperture of the pair of apertures, the drawstring having a diameter being less than a diameter of the pair of apertures wherein the drawstring is retractable into the channel through each aperture of the pair of apertures and wherein the drawstring is extendable outwardly from the channel through each aperture of the pair of apertures;

a fastener being coupled to the hood, the fastener being aligned with the channel wherein the fastener is selectively releasable to expose the channel and wherein the fastener is selectively engageable to cover the channel, the drawstring being accessible within the channel when the channel is exposed wherein the fastener is configured to facilitate a user in positioning the drawstring within the channel and removing the drawstring from the channel, the fastener having a length being equal to a length of the channel wherein the channel is fully exposed when the fastener is fully released, an entirety of the drawstring being accessible within the channel when the channel is fully exposed, the fastener being positioned proximate to a perimeter edge of the hood, the perimeter edge defining a junction between the outer surface and the inner surface;

a flap being pivotably coupled to the hood of the garment wherein the flap is selectively positionable in an open configuration and a closed configuration, the flap covering an entirety of the fastener when the flap is in the closed configuration, the flap exposing an entirety of the fastener when the flap is in the open configuration.

16. An apparel assembly comprising:

a garment having a waistband with an inner surface and an outer surface;

a channel extending through the waistband of the garment, the channel being positioned between the inner surface and the outer surface;

a drawstring being positioned within the channel, the drawstring having a pair of opposing ends;

a pair of apertures extending through the waistband into the channel, the drawstring extending outwardly from the channel through the pair of apertures wherein each opposing end of the pair of opposing ends is positioned outside of the channel proximate to a respective aperture of the pair of apertures, the drawstring having a diameter being less than a diameter of the pair of apertures wherein the drawstring is retractable into the channel through each aperture of the pair of apertures and wherein the drawstring is extendable outwardly from the channel through each aperture of the pair of apertures; and a fastener being coupled to the waistband, the fastener being aligned with the channel wherein the fastener is selectively releasable to expose the channel and wherein the fastener is selectively engageable to cover the channel, the drawstring being accessible within the channel when the channel is exposed wherein the fastener is configured to facilitate a user in removing the drawstring from the channel, the fastener having a length being equal to a length of the channel wherein the channel is fully exposed when the fastener is fully released, the fastener being positioned on the inner surface wherein the waistband is configured to inhibit visibility of the fastener while the user is wearing the garment, the fastener being positioned proximate to a perimeter edge of the inner surface, the perimeter edge defining a junction between the outer surface and the inner surface.

* * * * *